US011697262B2

(12) United States Patent
Gordon

(10) Patent No.: US 11,697,262 B2
(45) Date of Patent: Jul. 11, 2023

(54) SCORING RULE FOR FORMING A FOLDING SCORE ON A SHEET MATERIAL

(71) Applicant: Jonco Die Company, Inc., Mounds View, MN (US)

(72) Inventor: Kevin T. Gordon, Chisago, MN (US)

(73) Assignee: Jonco Die Company, Inc., Mounds View, MN (US)

( * ) Notice: Subject to any disclaimer, the term of this patent is extended or adjusted under 35 U.S.C. 154(b) by 257 days.

(21) Appl. No.: 15/376,103

(22) Filed: Dec. 12, 2016

(65) Prior Publication Data

US 2017/0087792 A1 Mar. 30, 2017

Related U.S. Application Data

(60) Continuation of application No. 14/603,676, filed on Jan. 23, 2015, now Pat. No. 10,022,933, which is a
(Continued)

(51) Int. Cl.
*B31B 50/25* (2017.01)
*B31B 50/00* (2017.01)
(Continued)

(52) U.S. Cl.
CPC ..... *B31B 50/25* (2017.08); *B31B 50/00* (2017.08); *B31B 50/14* (2017.08); *B31F 1/08* (2013.01);
(Continued)

(58) Field of Classification Search
CPC ..... B31F 1/10; B31F 1/08; B31B 1/25; B31B 17/00; B31B 2201/255; B31B 7/00;
(Continued)

(56) References Cited

U.S. PATENT DOCUMENTS 1,144,765 A 6/1915 Kelleher et al.
1,482,569 A 2/1924 Lange et al.
(Continued)

FOREIGN PATENT DOCUMENTS

WO 2012152576 A1 11/2012

OTHER PUBLICATIONS

Exxonmobil, "Product Datasheet: Santoprene 201-80 Thermoplastic Vulcanizate," Oct. 8, 2014, pp. 1-4, retrieved on Oct. 18, 2017 from website, http://exxonmobilchemical.ides.com/en-US/ds244520/Santoprene%E2%84%A2%20201-80.aspx?l=74710&U=1.

*Primary Examiner* — Sameh Tawfik
(74) *Attorney, Agent, or Firm* — Dorsey & Whitney LLP

(57) ABSTRACT

A scoring rule for forming a folding score on a sheet material includes a pair of score members with a scoring surface portions with individually asymmetrical flat outer surfaces extending at an angle. The score members press against a first side of the sheet material to cause a pair of laterally spaced fold score lines to be formed on the first side of the sheet material by the scoring surface portions. As the scoring rule engages the sheet material, a second, opposite side of the sheet material is compressed such that rubber-type material of an anvil of the rotary press bulges towards and forces the sheet material into an area between the pair of score members causing a self-contained single longitudinally inwardly extending groove to be formed on the second, opposite side of the sheet material along a line parallel to and positioned between the laterally spaced score lines.

3 Claims, 5 Drawing Sheets

Related U.S. Application Data continuation of application No. 13/875,697, filed on May 2, 2013, now Pat. No. 9,895,857, which is a continuation of application No. 12/436,855, filed on May 7, 2009, now Pat. No. 8,663,081, which is a division of application No. 10/919,738, filed on Aug. 17, 2004, now Pat. No. 8,444,539.

(51) Int. Cl.
*B31F 1/08* (2006.01)
*D21H 27/00* (2006.01)
*B31B 50/14* (2017.01)
*B31F 1/10* (2006.01)

(52) U.S. Cl.
CPC ..... *B31F 1/10* (2013.01); *D21H 1/00* (2013.01); *B31B 50/254* (2017.08); *Y10T 428/2457* (2015.01)

(58) Field of Classification Search
CPC ..... B31B 3/00; B31B 50/25; B31B 50/00; B31B 50/14; B31B 50/254; D21H 1/00; Y10T 428/2457
USPC ..... 493/59, 107, 160, 240
See application file for complete search history.

(56) References Cited

U.S. PATENT DOCUMENTS 2,949,066 A 8/1960 Bombard
2,949,827 A * 8/1960 Kempen ..... B31B 1/00 493/403
3,039,372 A * 6/1962 La Bombard ..... B31F 1/08 493/396
3,163,095 A 12/1964 Shreen
3,359,773 A 12/1967 Leslie et al.
3,526,566 A * 9/1970 McIlvain, Jr. ..... B31F 1/08 428/121
3,744,384 A * 7/1973 Jarritt ..... B26F 1/44 493/471
3,866,523 A 2/1975 Geschwender
3,884,132 A * 5/1975 Snodgrass ..... B23P 15/406 493/396
3,900,550 A * 8/1975 Oliver ..... B29C 53/06 138/177
3,907,193 A * 9/1975 Heller ..... B29C 53/063 229/930
3,916,749 A 11/1975 Armelin
3,917,254 A 11/1975 Watrous
3,919,924 A 11/1975 Snodgrass
3,981,213 A * 9/1976 Lopman ..... B26D 9/00 493/60
4,112,827 A 9/1978 Kang
4,195,556 A * 4/1980 Gallagher ..... B31F 1/10 493/403
4,348,449 A * 9/1982 Seufert ..... B29C 53/06 229/930
5,138,923 A * 8/1992 Kent ..... B26D 7/2614 403/358
5,163,894 A * 11/1992 Ogawa ..... B26F 1/44 493/396
5,194,064 A * 3/1993 Simpson ..... B31B 1/00 493/402
5,393,295 A * 2/1995 Knecht ..... B31F 1/10 493/396
5,429,577 A * 7/1995 Simpson ..... B26F 1/18 493/354
5,564,623 A * 10/1996 Kiley ..... A45C 3/02 229/164
5,823,935 A * 10/1998 Puhi ..... B26B 27/005 493/354
5,873,807 A * 2/1999 Lauderbaugh ..... B31B 50/00 493/403
6,071,225 A * 6/2000 Kucharski ..... B31B 1/00 493/396
6,162,155 A 12/2000 Gordon et al.
6,644,153 B1 11/2003 Gordon
6,682,468 B2 1/2004 Lauderbaugh
6,997,363 B1 2/2006 Vossen
7,824,321 B2 * 11/2010 Sato ..... B31F 1/10 493/241
7,918,775 B2 * 4/2011 Pohlmann ..... B31F 1/0012 493/402
8,088,054 B2 1/2012 Gordon
8,166,858 B2 5/2012 Luquette
8,201,482 B2 6/2012 Vossen
8,444,539 B2 5/2013 Gordon
8,663,081 B2 3/2014 Gordon
2006/0112803 A1 6/2006 Vossen
2009/0205475 A1 8/2009 Vossen
2011/0271808 A1 11/2011 Vossen
2011/0277607 A1 11/2011 Vossen
2013/0244007 A1 9/2013 Gordon
2015/0165711 A1 6/2015 Gordon

* cited by examiner

SCORING RULE FOR FORMING A FOLDING SCORE ON A SHEET MATERIAL

CROSS-REFERENCE TO RELATED APPLICATIONS

This application is a continuation of U.S. patent application Ser. No. 14/603,676, filed on Jan. 23, 2015, now issued as U.S. Pat. No. 10,022,933, which is a continuation of U.S. patent application Ser. No. 13/875,697, filed on May 2, 2013, now issued as U.S. Pat. No. 9,895,857, which is a continuation of U.S. patent application Ser. No. 12/436,855, filed May 7, 2009, now issued as U.S. Pat. No. 8,663,081, which is a divisional of U.S. patent application Ser. No. 10/919,738, filed on Aug. 17, 2004, now issued as U.S. Pat. No. 8,444,539; the entire contents of all are incorporated herein by reference.

This application is related to U.S. patent application Ser. No. 12/906,645, filed Oct. 18, 2010, issued as U.S. Pat. No. 8,088,054; the entire contents of of which is hereby incorporated by reference.

BACKGROUND OF THE INVENTION

Field of the Invention

The present invention relates generally to a folding score and a method and apparatus for forming such folding score. More particularly, the present invention relates to a reverse folding score and a method and apparatus for forming such reverse folding score in a panel of sheet material such as corrugated paperboard or the like.

Background

The processing of sheet material to transform such sheet material to a useable form such as a box, display device or the like normally involves utilizing a rotary die or flat die to cut a blank from the sheet material and to provide it with various scores, slits, etc. for the purpose of forming tear strips, punch outs, fold lines, etc. in the blank. These cuts, scores, slits, etc. are commonly formed through the use of cutting and creasing or scoring rules mounted into or onto the die.

To facilitate folding of sheet material such as corrugated paperboard, fold lines or scores are formed in the material by scoring dies, sometimes commonly referred to as scoring rules. Various configurations of folding lines or folding scores currently exist. These include, among others, single scores in which the sheet material is compressed or creased along a single line, double scores in which the sheet material is compressed or creased along a double line or pair of parallel lines, broken scores in which the sheet material is compressed or creased along a single or double line with intermittent areas of non-compression, and slit or perforal scores in which portions of the sheet material are cut along a single or double line, with areas where the material is not cut.

Although some of the above scores enable the sheet material to be reverse folded, i.e., folded in a direction away from the surface on which the score is formed, there is a continuing need in the art for a folding score which facilitates folding of a sheet material in a direction away from the scored surface, i.e., a reverse folding score.

SUMMARY OF THE INVENTION

The present invention is directed to a folding score and more specifically to a reverse folding score and to a method and apparatus for producing such a reverse score in a sheet material such as corrugated paperboard or the like. The reverse folding score in accordance with the present invention facilitates a reverse fold that is accurate and consistent and which is not prone to bursting from the stress of folding.

More specifically, the reverse folding score in accordance with the present invention is comprised of a pair of longitudinally extending, laterally spaced score lines on a first side of a sheet material and a longitudinally extending depression on a second, opposite side of the sheet material along a line parallel to and positioned between the spaced score lines. The score lines on the scoring surface are formed by a pair of asymmetrical scoring members and accordingly, such score lines are characterized by being asymmetrical. It has been found that this particular folding score surpasses the performance of closely spaced conventional double scores and results in a minimum amount of crushing between the score lines and a minimum amount of ridge created on the second side of the sheet material, opposite to the side on which the score is formed.

The invention also relates to a device or apparatus for forming the above described reverse folding score. One such device includes a scoring rule which is designed for mounting to or use with a die board for use in a rotary die. The scoring rule includes a pair of longitudinally extending first and second parallel score members which are laterally spaced from one another. These score members are asymmetrical and include scoring surfaces which engage and compress or crease spaced portions of the sheet material. In a rotary die, usable with the present invention, the anvil is preferably a soft anvil with an anvil blanket constructed of a compressible rubber-type material. Thus, when the score members compress spaced apart portions on the inside or scoring surface of the sheet material, spaced portions on the outside or non-scoring surface of the sheet material are compressed against the blanket and are forced into the area between the score members, causing a depression on the second side of the sheet material. Thus, in this situation, the anvil blanket essentially acts as a scoring rule itself and produces this depression on the outside of the scored material between the score members.

A further apparatus for forming the folding score of the present invention includes a die board having one or more attached scoring rules such as those described above. Such a die board would normally be utilized in conjunction with a flat or rotary die to cut a blank from a panel of sheet material and provide scores for fold lines and the like.

The method aspect of the present invention generally includes forming a fold line in a sheet material such as corrugated paperboard or the like by forming a pair of spaced score lines with a pair of asymmetrical scoring members.

Accordingly, it is an object of the present invention to provide a folding score for a foldable sheet material such as corrugated paperboard or the like which will permit the sheet material to be folded in a direction away from the scored surface of the sheet material.

Another object of the present invention is to provide an apparatus including a scoring rule for forming the folding score described above.

A further object of the present invention is to provide a method of forming a folding score as described above.

Further, a scoring rule for forming a folding score on a sheet material supplied between the scoring rule and an anvil, includes a pair of score members each comprising a scoring surface portion with an individually asymmetrical flat outer surface extending at an angle, the score members coupled to a die board of a die roll of a rotary press. The anvil comprises a compressible rubber-type material joined to an anvil roll of the rotary press. Upon compressing the sheet material, the pair of score members press against a first side of the sheet material such that the pair of scoring surface portions cause a pair of laterally spaced fold score lines to be formed on the first side of the sheet material, the score lines comprising a complementary shape to the scoring surface portions such that the score lines each comprise an individually asymmetrical surface, and as the scoring rule engages the sheet material, a second, opposite side of the sheet material is compressed against the anvil such that the rubber-type material of the anvil bulges towards the sheet material and forces the sheet material into an area between the pair of score members causing a self-contained single longitudinally inwardly extending groove to be formed on the second, opposite side of the sheet material along a line parallel to and positioned between the laterally spaced score lines.

These and other objects of the invention will become apparent with references to the drawings, the description of the preferred embodiment and method and to the appended claims.

DESCRIPTION OF THE PREFERRED EMBODIMENT

The present invention relates generally to an improved folding score, and more specifically, to a reverse folding score for a sheet material such as corrugated paperboard or the like. Although the folding score of the present invention has particular applicability as a reverse score to facilitate folding of the sheet material in a direction away from the scoring surface, it also facilitates folding of the sheet material in a forward direction, in the direction toward the scoring surface, and thus can be used as a normal folding score. The invention also relates to an apparatus and method for forming such folding score.

Although the present invention has particular applicability to sheet material commonly referred to as corrugated cardboard or paperboard, it also has applicability to paperboard which is not corrugated and to various other forms of sheet material which are foldable or made to be foldable. Thus, unless otherwise specified, the term "sheet material" as used herein shall mean any sheet material with which the present invention is usable including, but not limited to, corrugated paperboard, non-corrugated paperboard, sheet material with a honeycomb or other core material, and sheet material with no core, among others. Corrugated paperboard generally comprises a pair of outer layers of a paper or paper-like material and a plurality of substantially parallel flutes positioned therebetween. The preferred embodiment will be described with reference to corrugated paperboard as the sheet material.

The apparatus for forming the folding score of the present invention, and in particular the scoring rule and the die board, can be used with what is commonly referred as a rotary die or a flat die or any other form of die. The description of the preferred embodiment, however, will be with reference to a rotary die.

Figure 1:
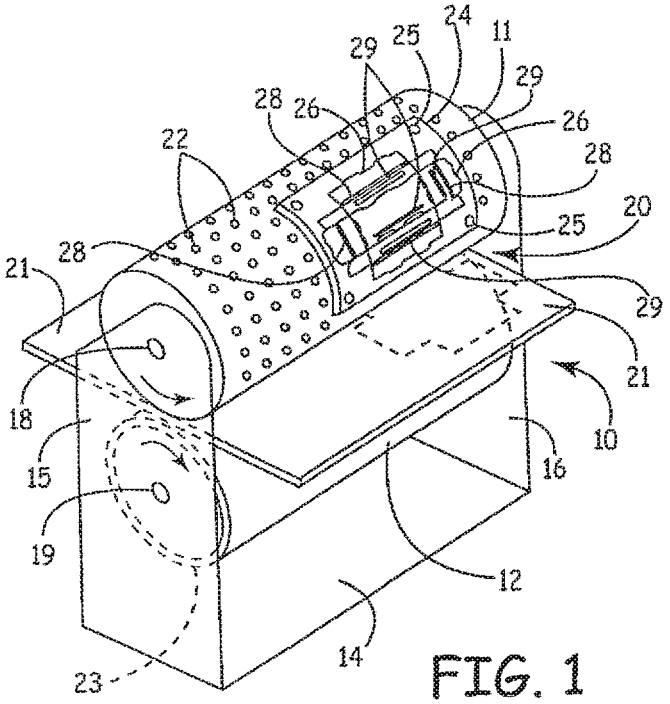
FIG. 1 is an isometric view of a rotary die and anvil embodying a die board and a scoring rule for forming the folding score in accordance with the present invention.

In describing the present invention, reference is first made to the FIG. 1 which shows a conventional rotary die or press 10 embodying a die board 24 with a scoring rule of the present invention as hereafter described. The rotary press 10 of FIG. 1 includes a die roll or cylinder 11, an anvil roll or cylinder 12 and a support structure comprising a base 14 and a pair of side supports 15 and 16. As shown, the die and anvil rolls 11 and 12 are rotatably mounted in the side supports 15 and 16 about their respective rotation axes 18 and 19. During operation, the rolls 11 and 12 rotate about their axes 18 and 19 in opposite directions as shown by the directional arrows.

The rolls 11 and 12 are adjacent to one another as shown, but are slightly spaced to define a nip 20 between them through which a panel of sheet material 21 passes during operation. This panel of sheet material 21 is preferably corrugated paperboard having parallel flutes or corrugations extending is a single direction. Normally, the panel 21 is fed through the nip 20 between the rollers 11 and 12 in a direction generally parallel to or perpendicular to the corrugation flutes, however, it can be fed through diagonally as well.

The die roll 11 is a right cylindrical metal roller having a plurality of internally threaded mounting holes 22 extending axially across and circumferentially around the roll 11. The anvil roll 12 is also a generally right cylindrical member having a core portion constructed of metal. It is common for the anvil roll 12 to be provided with an external cutting blanket 23 constructed of urethane or a similarly compressible material. In some applications, however, an anvil roll with a steel exterior is utilized. The preferred embodiment will be described with respect to a soft anvil having a compressible cutting blanket 23.

The die board 24 is securely mounted to the die roll 11 by a plurality of externally threaded members 25 such as bolts threadedly received in the mounting holes 22. The die board 24 is conventionally constructed of a material such as plywood and has a curvature substantially matching the curvature of the exterior surface of the roll 11. The die board 24 normally has a thickness ranging from about ⅜ to about ⅝ of an inch, but other thickness can be used as well. A plurality of cutting, creasing, scoring, slitting or other rules may be mounted to the die board 24 to perform desired operations on the sheet material 21 as it passes through the nip 20.

In the embodiment of FIG. 1, the die board is provided with a plurality of cutting rules 26 for cutting the sheet material 21 into a product blank and a plurality of scoring rules 28 for forming folding scores on the product blank cut from the sheet material 21. These scoring rules 28 may include a variety of different scoring rules, including scoring rules in accordance with the present invention. Also mounted to the die board 24 in a manner known in the art are a plurality of product or scrap ejection elements 29 in the form of pieces of compressible material adjacent to the cutting and scoring rules 26 and 28. These elements 29 force the product and scrap material away from each other and outwardly and away from the die roll 11 and the die base 24 during the cutting and scoring process.

The general structure of the rotary die of the rotary press illustrated in FIG. 1 is conventional and known in the art. During operation, the die and anvil rolls 11 and 12 rotate in the direction of the indicated arrows and the panel of sheet material 21 is fed into the nip 20 between the rollers. As the rules 26 and 28 of the die board engage the sheet material 21, the sheet material is cut into a product blank having a desired configuration and folding scores are formed on the scoring surface of the product blank at desired locations.

Figure 3A:
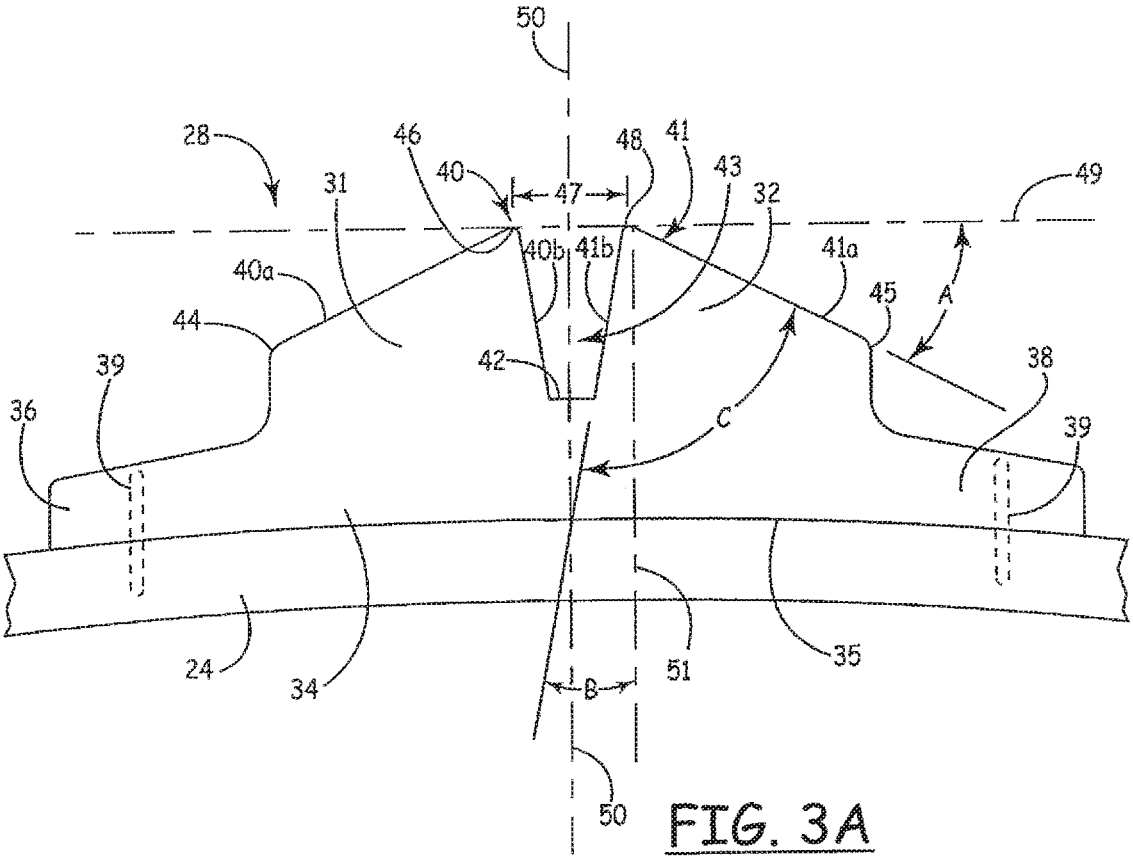
FIGS. 3A-3B show a cross-sectional view of the scoring rule of FIG. 2 connected to a die board of a rotary die in an axial direction (FIG. 3A) and connected to a die board of a rotary die in a circumferential direction (FIG. 3B).
Figure 2:
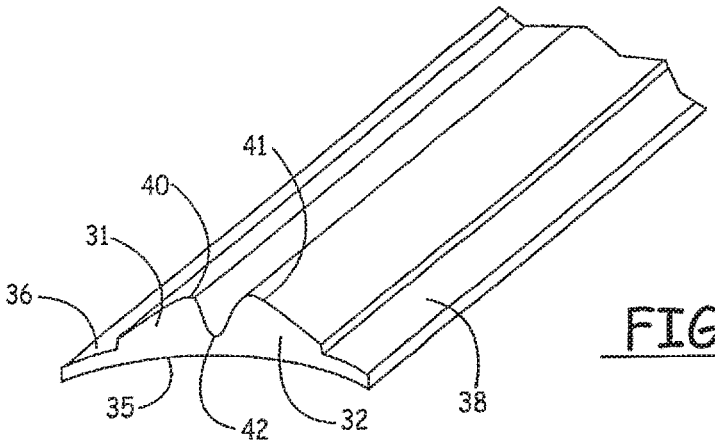
FIG. 2 is an isometric view of a portion of a scoring rule for forming the folded score in accordance with the present invention.
Figure 3B:
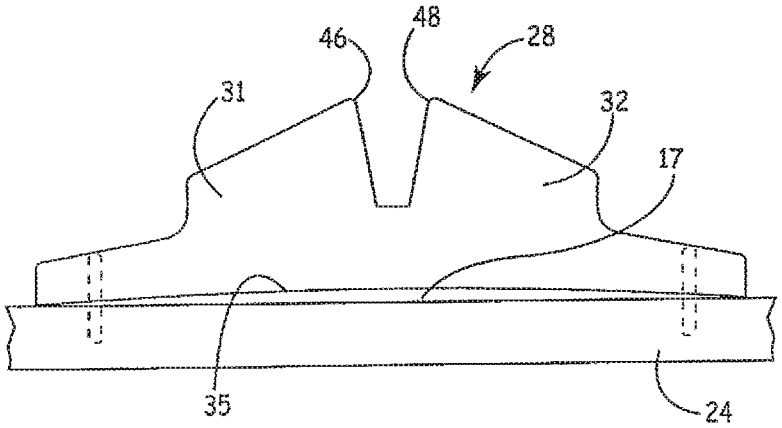

Reference is next made to FIGS. 2 and 3A-3B showing isometric and cross sectional views of a scoring rule 28 in accordance with the present invention. As shown, the scoring rule 28 includes a pair of longitudinally extending, laterally spaced, parallel scoring members 31 and 32. Each of the scoring members 31 and 32 is asymmetrical and each is the mirror image of the other.

In the embodiment of FIGS. 2 and 3A-3B, the scoring members 31 and 32 are integrally formed with a base portion 34. The base portion 34 includes an inner or proximal surface 35 which is adjacent to the die board 24 when the scoring rule 28 is connected to the die board 24. In the preferred embodiment, the inner base surface 35 is provided with a radius extending across the width of the rule 28. This radius has a center along a line substantially parallel to the longitudinal axis of the scoring rule 28 and lying in the plane 50 defining the symmetrical center of the scoring rule 28 (FIGS. 3A-3B). The radius of the inner surface 35 approximates the radius of the die board 24 in the circumferential direction. Accordingly, when the scoring rule 28 is mounted on the die board 24 in the axial direction of the die roll 11 as shown in FIG. 3A, the surface 35 substantially conforms to the outer surface of the die board 24. When the scoring rule 28 is mounted on the die board 24 in the circumferential direction of the die roll 11 as shown in FIG. 3B, a small gap 17 exists between the surface 35 and the die board 24 in the central area. Although a radius is preferred, such radius of the surface 35 is not required as shown by several of the further embodiments below.

The outermost lateral portions of the base 34 include longitudinally extending holdown or connection flanges 36 and 38. These flanges 36 and 38 provide a means by which the scoring rule 28 can be connected with the die board 24. Such connection may be either in an axial direction substantially parallel to the rotational axis of the die rule 11, circumferentially in a direction along the circumference of the die rule 11 or diagonally in a diagonal direction along the surface of the die rule 11. The scoring rule 28 may be connected to the die board 24 by connecting members 39 such as staples, rivets, or the like, which extend through the flanges 36 and 38 and into the die board 24.

The scoring members of 31 and 32 are individually asymmetrical and include scoring surfaces 40 and 41, respectively, defined by scoring surface portions 40*a* and 40*b* and 41*a* and 41*b*. Each of the scoring surface portions 40*a* and 41*a* are outer surface portions in that they face away from each other, while each of the scoring surface portions 40*b* and 41*b* are inner surface portions which face toward one another. In the embodiment of FIGS. 3A-3B, the inner scoring surface portions 40*b* and 41*b* define a groove or channel 43 between them. The channel 43 preferably includes a base 42.

During operation, the scoring surfaces 40 and 41 engage and press against the scoring surface of a sheet material and form an indentation into such sheet material to form the score in accordance with the present invention. Because each of the scoring members 31 and 32, and thus the scoring surfaces 40 and 41 is individually asymmetrical, each of the score lines created in the sheet material by such scoring surfaces 40 and 41 is also asymmetrical.

As shown in the embodiment of FIGS. 3A-3B, each of the scoring members 31 and 32 includes a shoulder portion 44 and 45 forming a transition between the surfaces 40 and 41 and the lateral flanges 39,39. The outer surface portions 40*a* and 41*a* extend from the shoulders 44 and 45 to the junction points 46 and 48, respectively. At the points 46 and 48, the outer surface portions 40*a* and 41*a* transition into the inner surface portions 40*b* and 41*b*. The inner surfaces portions 40*b* and 41*b* extend and converge inwardly toward and terminate at the base 42. Preferably the points 46 and 48 form a small radius which is large enough to prevent the sheet material from being cut during a scoring operation.

In the preferred embodiment of FIGS. 3A-3B, the surface portions 40*a* and 41*a* are substantially flat and planar surfaces which form an angle "A" relative to the plane 49 which is perpendicular to the plane 50 which passes through the symmetrical center of the scoring rule 28. The inner surface portions 40*b* and 41*b* in the preferred embodiment of FIGS. 3A-3B are also substantially flat and planar and each is positioned at an angle "B" relative to the plane 51 which is substantially parallel to the plane 50 defining the symmetrical center of the scoring rule 28. Together, the surface portions 40*a* and 40*b* and the surface portions 41*a* and 41*b* form an included angle "C".

Preferably, the angle "A" should range from about 20° to 50°, more preferably, from about 20° to 40° and most preferably, from about 20° to 30°. The angle "B" should preferably range from about 0° to 30°, more preferably, from about 5° to 25° and most preferably, from about 10° to 20°. The included angle "C" should preferably range from about 60° to 90°, more preferably, from about 70° to 90° and most preferably, from about 80° to 90°. As shown by the above ranges, it is preferable for the complement of the angle "A" (the angle which the surface portions 40*a* and 41*a* form with the plane 51) to be greater than the angle "B". In general, this results in the surface portions 40*a* and 41*a* being flatter than their respective surface portions 40*b* and 41*b* relative to the die board on which the rule 28 is mounted, and the surface portions 40*b* and 41*b* being steeper than their respective surface portions 40*a* and 41*a*.

The length of the surface portions 40*a*, 41*a* and 40*b*, 41*b* should preferably be sufficiently long so that they contact the scoring surface of the sheet material to form the folding score of the invention.

The depth of the channel 43 (measured from the points 46 and 48 to the base 42) is dictated primarily by the thickness of the sheet material to be scored and can range from about ⅛ inch or shorter to ½ inch or more, depending upon the thickness of the material to be scored.

The distance between the pair of scoring members 31 and 32 as defined by the distance 47 between the junction points 46 and 48 will vary with the particular characteristics of the sheet material to be scored and the desired distance between the pair of scores on such sheet material. In general, this distance will vary from about ⅛ of an inch or smaller to as much as ½ inch or larger. Thus, the spacing of the two scoring members 31 and 32, whether comprised of a unitary construction as shown in the preferred embodiment or as two separate pieces, as shown in the alternate embodiment of FIG. 4, may be varied to achieve optimum results for paper grades and thicknesses. In general, use of the present score on heavier weight papers requires more space or distance between the scoring members to overcome the rigidity of the heavier papers and to provide the required clearance so as to avoid bunching of the material during the backwards or reverse fold of the sheet material.

Accordingly, in accordance with the preferred embodiment shown in FIGS. 2 and 3A-3B, the scoring rule 28 includes a pair of longitudinally extending, laterally spaced and parallel scoring members which, in cross-section, are substantially mirror images of one another, but which are individually asymmetrical. In other words, each of the scoring members 31 and 32 includes scoring surfaces or surface portions which extend from the junction points 46 and 48 at different angles relative to the plane 51 which is substantially parallel to the plane 50 defining the symmetrical center of the rule 28. In the preferred embodiment, these surface portions 40*a* and 40*b* for the scoring member 31 and 41*a* and 41*b* for the scoring member 32 are substantially planar. The inner surface 35 of the base 34 is preferably formed with a radius relative to an axis substantially parallel to the longitudinal axis of the scoring rule 28 and which radius substantially matches the radius of the die board 24.

Preferably, the material from which the scoring rule 28 of the present invention is made is a relatively hard and dense material such as an ultra-high molecular weight (UHMW) material. In the preferred embodiment, the scoring rule 28 is constructed of a UHMW material such as polyethylene. Preferably, the material also exhibits a low coefficient of friction which enables the scoring rule 28 to be readily released from the sheet material during the scoring operation. The scoring rule in accordance with the present invention is preferably constructed via an extrusion of process, although it can be machined or formed via other processes as well.

Figure 4:
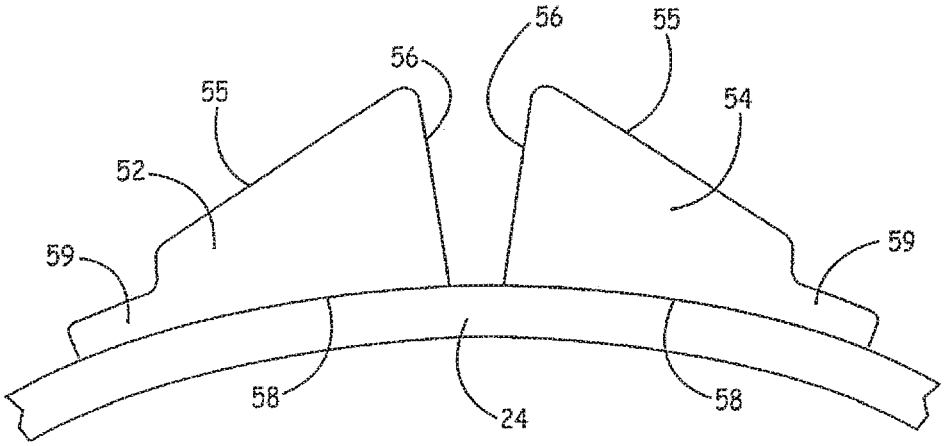
FIG. 4 is a cross-sectional view of a further embodiment of a scoring rule in accordance with the present invention.

Reference is next made to FIGS. 4, 5, 6, 7, 8 and 9 showing various further embodiments in accordance with the present invention. In the preferred embodiment shown in FIGS. 2 and 3A-3B, the scoring rule 28 is of a one-piece, unitary construction having a pair of scoring members which are substantially mirror images of one another, but which are individually asymmetrical. FIG. 4 shows a similar structure constructed of two separate scoring members 52 and 54. Each of these scoring members 52 and 54 includes an outer scoring surface portion 55,55 facing away from one another and an inner scoring surface portion 56,56 facing toward one another. Each of the scoring members 52 and 54 includes a base surface 58 for positioning adjacent to a die board 24 and a pair of lateral connection flanges 59,59. To simulate the unitary structure of the scoring rule 28 of the preferred embodiment, the scoring members 52 and 54 are mounted to the die board 24 so that they are substantially parallel to one another.

Figure 5:
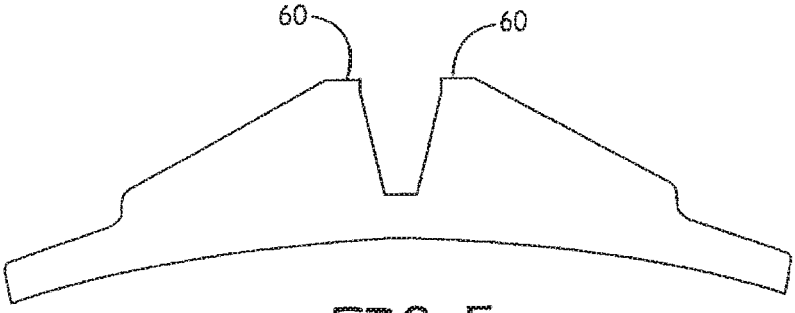
FIG. 5 is a cross-sectional view of a further embodiment of a scoring rule in accordance with the present invention.

In the preferred embodiment of FIGS. 2 and 3A-3B, the scoring surface portions 40*a* and 40*b* meet at a junction point 46 and the surface portions 41*a* and 41*b* meet at a junction point 48. In FIGS. 2 and 3A-3B, these junction points 46 and 48 are shown substantially as a point with a minimal radius. If desired, however, these junction points can actually form short lateral surfaces 60,60 such as shown in FIG. 5 or, alternatively, may form a radius which is larger than that shown in the preferred embodiment of FIGS. 2 and 3A-3B.

Figure 6:
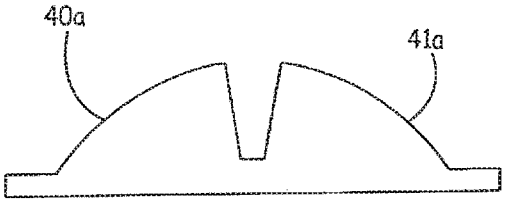
FIG. 6 is a cross-sectional view of a further embodiment of a scoring rule in accordance with the present invention.
Figure 7:
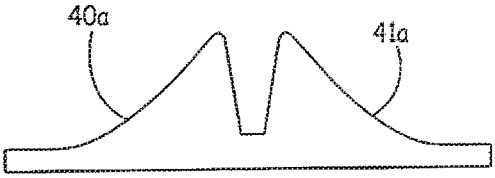
FIG. 7 is a cross-sectional view of a further embodiment of a scoring rule in accordance with the present invention.

In the preferred embodiment of FIGS. 2 and 3A-3B, the scoring surface portions 40*a* and 41*a* are substantially flat and planar. As shown in FIGS. 6 and 7, however, these surfaces may be convex as shown in FIG. 6 or concave as shown in FIG. 7. Similarly, although not shown, the inner surfaces 40*b* and 41*b* of FIGS. 2 and 3A-3B may also embody a surface configuration other than being flat and planar such as slightly convex or concave.

Figure 8:
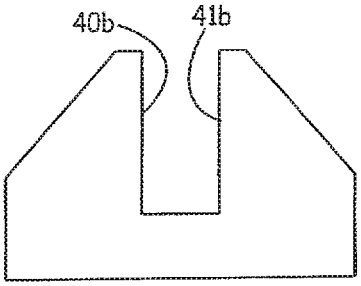
FIG. 8 is a cross-sectional view of a further embodiment of a scoring rule in accordance with the present invention.
Figure 9:
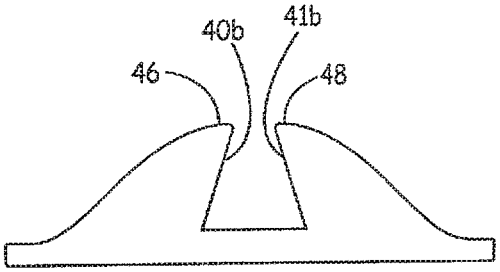
FIG. 9 is a cross-sectional view of a further embodiment of a scoring rule in accordance with the present invention.

In the preferred embodiment of FIGS. 2 and 3A-3B, the inner scoring surface portions 40*b* and 41*b* extend from their respective junction points 46 and 48 in a direction which converges toward the base 42. Thus, in the preferred embodiment, the surfaces 40*b* and 41*b* converge inwardly and toward one another at the angle "B". In some applications, however, the inner surfaces 40*b* and 41*b* may be substantially parallel as shown in FIG. 8 or may diverge outwardly as they extend from the junction points 46 and 48 as shown in FIG. 9.

Figure 10:
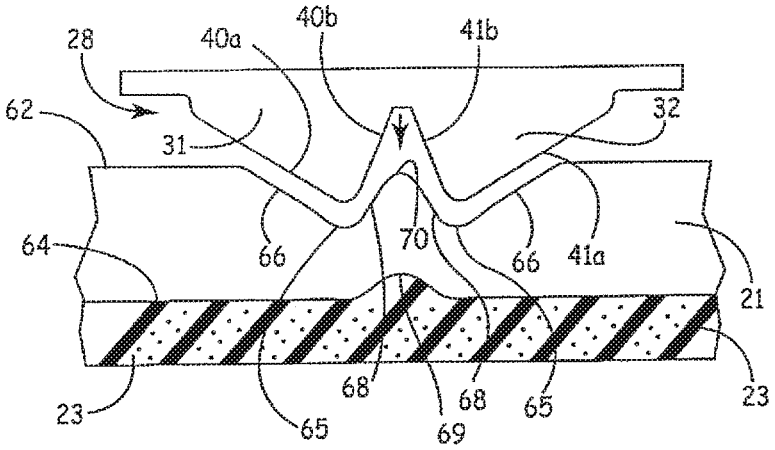
FIG. 10 is an enlarged cross-sectional view of a section of corrugated paperboard showing the folded score in accordance with the present invention.

FIG. 10 is an enlarged cross-sectional view showing the folding score in accordance with the present invention. Such score is formed by the scoring rule 28 of FIGS. 2 and 3A-3B pressed against a soft anvil blanket 23. In FIG. 10, the sheet material is in the form of the corrugated sheet 21 and includes a first surface to be scored 62 and a second opposite surface 64 which engages the soft anvil blanket 23. When the scoring rule 28 is moved into engagement with the surface 62 in the direction as shown, the pair of scoring members 31 and 32 engage the surface 62 and form a corresponding pair of scoring grooves or channels 65 and 65 in the corrugated board 21. Each of these grooves or channels 65,65 includes an outer surface 66,66 formed by the scoring surface portions 40*a* and 41*a* and an inner surface 68,68 formed by the scoring surface portions 40*b* and 41*b*. Because the respective scoring surface portions 40*a*, 40*b* and 41*a*, 41*b* are not symmetrical, the formed surfaces 66,68 and 66,68 are also not symmetrical. Thus, one characteristic of the score in accordance with the present invention is that it comprises a pair of parallel grooves or channels 65,65 which are formed from asymmetrical scoring members, or asymmetrical scoring surface portions, and which accordingly exhibit corresponding asymmetrical surface portions.

As the pair of scoring members 31 and 32 move against the surface 62 and toward the blanket 23, the scoring members 31 and 32 depress portions of the sheet material 21 against the blanket 23 and cause the depressed blanket 23 to bulge outwardly and thus form a small inwardly extending groove or channel 69 in the opposite surface 64 of the corrugated board 21 between the grooves 65,65. This results in a corresponding outwardly extending bulge or rib 70 in the surface 62 of the corrugated board 21. Thus, the score in accordance with the present invention includes a pair of parallel score channels or grooves 65,65 formed in a first side of a sheet material in which such channels or grooves are asymmetrical and which also includes a further groove or channel 69 formed in the opposite, second side of the sheet material between the pair of channels or grooves

65,65. Such further channel or groove 65 results in a corresponding bulge or rib 70 on the first side of the sheet material.

Figure 11:
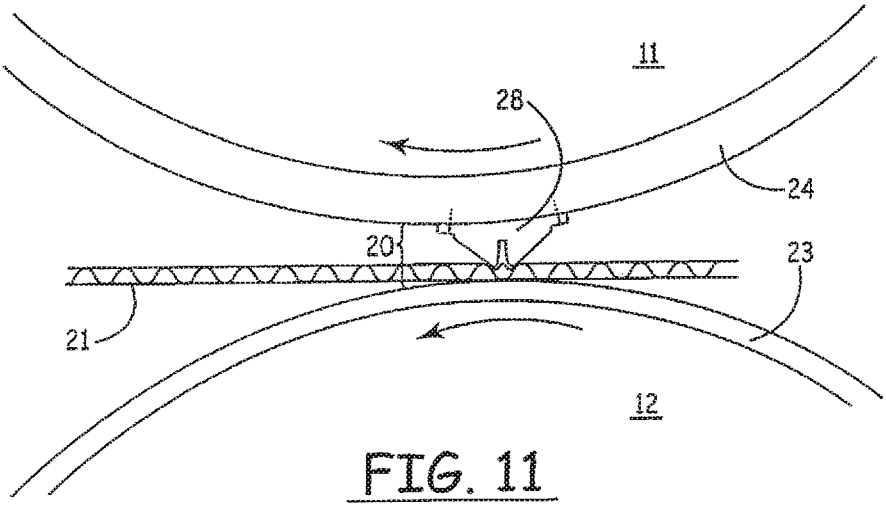
FIG. 11 is an enlarged side view of the apparatus of FIG. 1 in the area of the nip, showing formation of the folding score.

FIG. 11 is a cross-sectional, enlarged view of the die roll 11 and anvil roll 12 of FIG. 1 in the area of the nip 20. As shown, the scoring rule 28 is mounted to the die board 24. When the die roll 11 and the anvil roll 12 rotate in the directions shown, the scoring rule 28 engages and presses against the corrugated board 21 against the blanket 23, resulting in the formation of the score shown in FIG. 10.

Although the description of the preferred embodiment and alternate embodiments has been quite specific, it is contemplated that various modifications could be made without deviating from the spirit of the present invention. Accordingly, it is intended that the scope of the present invention be dictated by the appended claims rather than by the description of the preferred and alternate embodiments.

What is claimed is:

1. A scoring rule for forming a folding score on a sheet material supplied between the scoring rule and an anvil, comprising:

a pair of score members each individually asymmetrical and comprising an outer scoring surface portion with a flat, planar surface extending at a constant angle from a junction point between the flat, planar surface and an inner scoring surface, the score members coupled to a die board of a die roll of a rotary press, wherein the anvil comprises a flat, compressible rubber-type material joined to an anvil roll of the rotary press, the anvil roll having a flat, curved outer surface bound to the compressible rubber-type material; and wherein as the sheet material is compressed between the pair of score members and the flat, curved outer surface of the anvil roll, the pair of score members press against a first side of the sheet material, the pair of scoring surface portions form a pair of laterally spaced fold score lines on the first side of the sheet material, the score lines comprising a complementary shape to the scoring surface portions, wherein the score lines each comprise an individually asymmetrical surface, and as the scoring rule engages the sheet material, a second, opposite side of the sheet material is compressed against the flat, curved outer surface of the anvil roll, and the rubber-type material of the anvil bulges towards the die roll and the sheet material and forces the sheet material into an area between the pair of score members forming a self-contained single longitudinally inwardly extending groove on the second, opposite side of the sheet material along a line parallel to and positioned between the laterally spaced score lines.

2. The scoring rule of claim 1, wherein the pair of scoring members are of two pieces.

3. The scoring rule of claim 1, wherein the pair of scoring members are of a one-piece, unitary construction.

* * * * *